US011383405B2

(12) United States Patent
Ito et al.

(10) Patent No.: US 11,383,405 B2
(45) Date of Patent: Jul. 12, 2022

(54) METHODS FOR PRODUCING CERAMIC MOLDED BODY AND CERAMIC STRUCTURE

(71) Applicant: NGK INSULATORS, LTD., Nagoya (JP)

(72) Inventors: Keita Ito, Nagoya (JP); Yuichi Tajima, Nagoya (JP); Yoshimasa Kondo, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 17/136,390

(22) Filed: Dec. 29, 2020

(65) Prior Publication Data

US 2021/0291401 A1 Sep. 23, 2021

Related U.S. Application Data

(63) Continuation of application No. PCT/JP2020/012764, filed on Mar. 23, 2020.

(51) Int. Cl.

| | |
|---|---|
| ***B28B 3/20*** | (2006.01) |
| ***B28B 11/24*** | (2006.01) |
| ***B28B 11/12*** | (2006.01) |

(52) U.S. Cl.

CPC ..... *B28B 3/20* (2013.01); *B28B 11/12* (2013.01); *B28B 11/243* (2013.01); *B28B 2003/203* (2013.01)

(58) Field of Classification Search

CPC ..... B28B 3/20; B28B 11/12; B28B 11/243; B28B 2003/203; B28B 17/0072; B28B 17/0081; B28B 17/026

See application file for complete search history.

(56) References Cited

U.S. PATENT DOCUMENTS 2,630,616 A * 3/1953 Robinson ..... C01F 7/025 501/127
4,364,881 A 12/1982 Mizuno et al.
5,064,586 A * 11/1991 Higashijima ..... B28B 3/22 264/40.6

(Continued)

FOREIGN PATENT DOCUMENTS

DE 10 2019 000 822 A1 8/2019
JP S53-21209 A1 2/1978

(Continued)

OTHER PUBLICATIONS

International Search Report (PCT/ISA/210) (Application No. PCT/JP2020/012764) dated Jun. 2, 2020.

(Continued)

*Primary Examiner* — Jacob T Minskey
*Assistant Examiner* — Caroline Beha
(74) *Attorney, Agent, or Firm* — Burr & Brown, PLLC

(57) ABSTRACT

A method for producing a ceramic molded body, the method including: a molding step of subjecting a ceramic molding material to extrusion molding using an extrusion molding machine equipped with a temperature control portion to provide a ceramic molded body; a cutting step of cutting the ceramic molded body to have a predetermined length; and a dimension measuring step of measure a dimension of the cut ceramic molded body. A relationship between a temperature of the temperature control portion and the dimension of the cut ceramic molded body is previously obtained, and based on the relationship, an appropriate temperature of the temperature control portion is calculated from the dimension of the ceramic molded body measured in the dimension measuring step, and the temperature control portion is controlled to the appropriate temperature in the molding step.

6 Claims, 4 Drawing Sheets

(56) References Cited

U.S. PATENT DOCUMENTS

| | | | | |
|---|---|---|---|---|
| 5,116,554 | A * | 5/1992 | Shinmoto | B29C 48/865 264/40.1 |
| 2010/0244308 | A1* | 9/2010 | Yamazaki | B30B 11/243 264/177.12 |
| 2011/0049741 | A1* | 3/2011 | Brown | G05B 19/41875 264/40.1 |
| 2011/0278753 | A1* | 11/2011 | Breuer | B29C 48/06 264/40.1 |
| 2012/0133065 | A1 | 5/2012 | Caffrey et al. | |
| 2014/0151915 | A1 | 6/2014 | Sariego et al. | |
| 2016/0288366 | A1 | 10/2016 | Tajima et al. | |
| 2017/0274555 | A1* | 9/2017 | Yamada | B28B 11/243 |
| 2017/0355102 | A1 | 12/2017 | Citriniti et al. | |
| 2019/0248593 | A1 | 8/2019 | Hayakawa et al. | |

FOREIGN PATENT DOCUMENTS

| | | | |
|---|---|---|---|
| JP | 2000-153514 | A1 | 6/2000 |
| JP | 2003-104776 | A1 | 4/2003 |
| JP | 2004-202786 | A | 7/2004 |
| JP | 2005-280086 | A1 | 10/2005 |
| JP | 2007-237653 | A1 | 9/2007 |
| JP | 2013-545641 | A1 | 12/2013 |
| JP | 2015-058591 | A | 3/2015 |
| JP | 2016-193590 | A1 | 11/2016 |
| JP | 2017-170869 | A1 | 9/2017 |
| JP | 2017-536549 | A1 | 12/2017 |
| JP | 6258962 | B2 | 1/2018 |
| JP | 2018-199616 | A | 12/2018 |
| JP | 6436928 | B2 | 12/2018 |

OTHER PUBLICATIONS

International Written Opinion (PCT/ISA/237) (Application No. PCT/JP2020/012764) dated Jun. 2, 2020 (with English translation).
German Office Action (with English translation), German Application No. 11 2020 000 052.4, dated Sep. 21, 2021 (13 pages).
Chinese Office Action (with English translation) dated Apr. 27, 2022 (Application No. 202080002405.2).

* cited by examiner

METHODS FOR PRODUCING CERAMIC MOLDED BODY AND CERAMIC STRUCTURE

FIELD OF THE INVENTION

The present invention relates to methods for producing a ceramic molded body and a ceramic structure.

BACKGROUND OF THE INVENTION

Ceramic structures are used for various applications. For example, a honeycomb-shaped ceramic structure having partition walls that define a plurality of cells each extending from a first end face to a second end face is widely used for catalyst supports, and for various filters such as diesel particulate filters (DPFs), and gasoline particulate filters (GPFs).

The ceramic structure is produced by extruding a ceramic molding material (kneading material) containing ceramic raw materials to obtain a ceramic molded body, and then cutting the ceramic molded body to have a predetermined length, drying and firing it. As used herein, the ceramic molded body refer to a material in a state before firing, and the ceramic structure refers to a material in a state after firing.

In recent years, there is a requirement for improvement of dimensional accuracy of the ceramic structure from the viewpoint of increasing productivity of the ceramic structure or the like. To address the requirement, a method for improving the dimensional accuracy of the ceramic molded body before firing has been proposed. For example, Patent Literature 1 proposes a method of controlling extrusion molding process parameters (e.g., an extrusion pressure) by acquiring a shape signal of an outer peripheral surface of a ceramic molded body obtained by extrusion molding, and comparing in real-time the shape signal with a reference shape signal. Further, Patent Literature 2 proposes a method of measuring a dimension of a ceramic molded body that has been extruded and dried, and adjusting an amount of liquid to be added to a kneading material based on the measurement result.

CITATION LIST

Patent Literatures

[Patent Literature 1] Japanese Patent Application Publication No. 2017-536549 A

[Patent Literature 2] Japanese Patent No. 6436928 B

SUMMARY OF THE INVENTION

The present invention relates to a method for producing a ceramic molded body, the method comprising:

a molding step of subjecting a ceramic molding material to extrusion molding using an extrusion molding machine equipped with a temperature control portion to provide a ceramic molded body;

a cutting step of cutting the ceramic molded body to have a predetermined length; and a dimension measuring step of measure a dimension of the cut ceramic molded body;

wherein a relationship between a temperature of the temperature control portion and the dimension of the cut ceramic molded body is previously obtained, and based on the relationship, an appropriate temperature of the temperature control portion is calculated from the dimension of the ceramic molded body measured in the dimension measuring step, and the temperature control portion is controlled to the appropriate temperature in the molding step.

Also, the present invention relates to a method for producing a ceramic structure, the method comprising:

a drying step of drying the ceramic molded body obtained by the method for producing the ceramic molded body; and a firing step of firing the dried ceramic molded body.

DETAILED DESCRIPTION OF THE INVENTION

Figure 1:
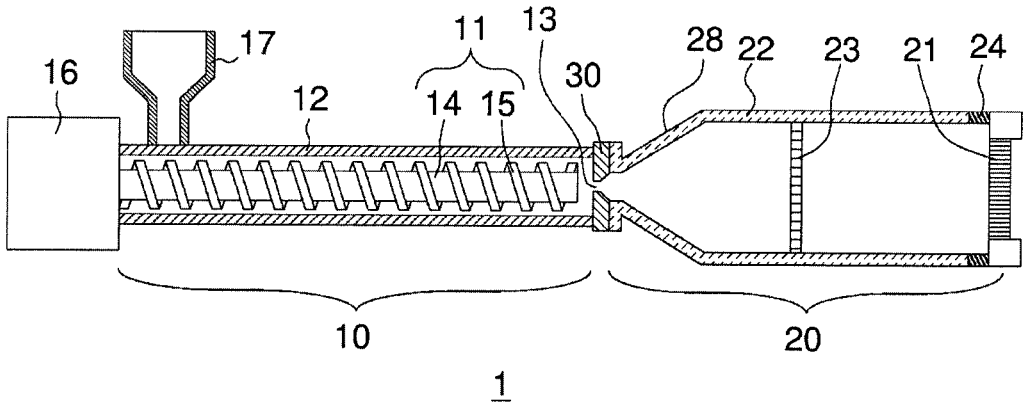
FIG. 1 is a schematic view illustrating a schematic structure of an extrusion molding machine suitable for use in a method for producing a ceramic molded body according to an embodiment of the present invention.

When the ceramic molded body obtained by extrusion molding is cut to have a predetermined length, the shape may be deformed due to the stress accumulated during extrusion molding. Therefore, in the method disclosed in Patent Literature 1 which controls the extrusion process parameters by measuring the shape immediately after extrusion molding, the deformation caused by cutting cannot be considered, and the dimensional accuracy of the ceramic molded body cannot be stably improved.

Further, since the drying of the ceramic molded body requires a long period of time, the method disclosed in Patent Literature 2 which measures the shape of the ceramic molded body after drying and adjusts the amount of the liquid to be added to the kneading material requires a long period of time until the adjustment is reflected. Therefore, in some cases, the produced ceramic molded bodies may be wasted until the adjustment is reflected.

The present invention has been made to solve the above problems. An object of the present invention is to provide a method for producing a ceramic molded body, which can quickly and stably improve dimensional accuracy of the ceramic molded body.

Another object of the present invention is to provide a method for producing a ceramic structure, which can stably improve dimensional accuracy of the ceramic structure.

As a result of intensive studies to solve the above problems, the present inventors have found that there is a correlation between a dimension of a ceramic molded body cut in a cutting step and a temperature of a temperature control portion in a molding process, and based on this finding, the dimension of the ceramic molded body cut in the cutting step is measured, and the temperature of the temperature control portion in the molding step is controlled based on the measured dimension, whereby the dimensional accuracy of the ceramic molded body can be quickly and stably improved, and they have completed the present invention.

According to the present invention, it is possible to provide a method for producing a ceramic molded body, which can quickly and stably improve dimensional accuracy of the ceramic molded body.

Also, according to the present invention, it is possible to provide a method for producing a ceramic structure, which can stably improve dimensional accuracy of the ceramic structure.

Hereinafter, embodiments of the present invention will be specifically described. It is to understand that the present invention is not limited to the following embodiments, and those which appropriately added changes, improvements and the like to the following embodiments based on knowledge of a person skilled in the art without departing from the spirit of the present invention fall within the scope of the present invention.

(1) Method for Producing Ceramic Molded Body

A method for producing a ceramic molded body according to an embodiment of the present invention includes: a molding step of subjecting a ceramic molding material to extrusion molding using an extrusion molding machine equipped with a temperature control portion to provide a ceramic molded body; a cutting step of cutting the ceramic molded body to have a predetermined length; and a dimension measuring step of measure a dimension of the cut ceramic molded body.

(Molding Step)

The molding step is to extrude a ceramic molding material using an extrusion molding machine equipped with a temperature control portion to obtain a ceramic molded body.

The extrusion molding machine is not particularly limited as long as it has a temperature control portion, and a machine known in the art can be used. Here, FIG. 1 shows a schematic view illustrating a schematic structure of a typical extrusion molding machine.

As shown in FIG. 1, the extrusion molding machine 1 includes; an extruding portion 10; a molding portion 20 connected to the extruding portion 10; and a rectifier 30 arranged between the extruding portion 10 and the molding portion 20. The extruding portion 10 has a screw 11 and a barrel 12 capable of housing the screw 11. Further, the molding portion 20 includes one end and other end, and the one end has a die 21, and the other end is connected to an extruding port 13 of the extruding portion 10, and the upstream side of the die 21 is provided with a screen (filtering net) 23 and a temperature control portion 24.

The extruding portion 10 is not particularly limited as long as it has the screw 11 and the barrel 12 capable of housing the screw 11. Any member known in the art can be used.

The screw 11 preferably has a screw shaft 14 and a blade portion 15 that is spirally formed along the screw shaft 14.

Further, the screw 11 is preferably a biaxial screw that rotates in the same direction, from the viewpoint of kneading properties of the ceramic molding material, and more preferably a meshing type biaxial screw. In this case, a pair of screws 11 are arranged in parallel inside the barrel 12.

A base portion of the screw 11 is connected to a drive device 16. The drive device 16 includes a motor and a gearbox (not shown), and controls a rotation speed so as to obtain a predetermined extrusion pressure and rotates the screw 11.

Provided on an upstream side of the extruding portion 10 is a material introducing portion 17 for feeding a ceramic raw material mixture into the extruding portion 10. The ceramic raw material mixture fed from the material introducing portion 17 is kneaded by the screw 11 to form a ceramic molding material, which is fed to the molding portion 20.

The molding portion 20 includes a drum 22 having a space therein. One end of the molding portion 20 has a die 21, and the other end is connected to the extruding portion 13 of the extruding portion 10.

A shape of the drum 22 is not particularly limited, and a part of the dram 22 may have a decreased diameter portion or an increased diameter portion. For example, as shown in FIG. 1, the drum 22 has the decreased diameter portion on the extruding port 13 side. The drum 22 having such a structure may be composed of one member or may be composed of a plurality of members. When the drum 22 is composed of a plurality of members, the drum 22 can be obtained by combining an increased diameter drum and a straight drum.

A shape of the die 21 is not particularly limited, and it can be appropriately set according to the shape of the ceramic molded body to be produced. For example, when producing a ceramic molded body having a honeycomb shape, the die 21 having slits corresponding to the thickness of the partition walls in the form of honeycomb is used.

The screen 23 is provided in the drum 22 (molding portion 20), and is formed of a material in the form of mesh. The screen 23 can remove coarse particles or other impurities mixed in the ceramic molding material to stabilize the ceramic molding material fed to the die 21.

The temperature control portion 24 is arranged between the screen 23 and the die 21.

The temperature control portion 24 is not particularly limited as long as it can control the temperature of the ceramic molding material. Any temperature controller known in the art can be used. Among others, it is preferable to use a temperature control drum through which a fluid can flow, as the temperature control portion 24. Since the temperature control drum can control the temperature by adjusting the temperature of the fluid, it is possible to reduce the consumption of electricity as compared with a case where a heating means such as a heating element is used. For example, the ceramic molding material can be easily and efficiently heated by circulating hot water having a temperature controlled by using a boiler or the like through the temperature control drum.

Figure 2:
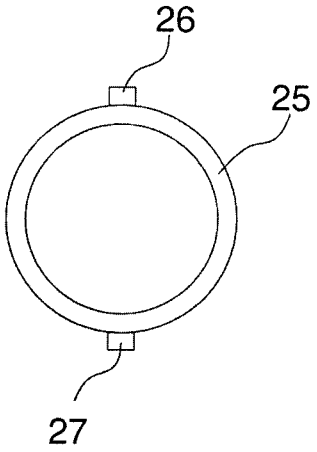
FIG. 2 is a front view of a temperature control drum as viewed from a drum side.

Here, FIG. 2 shows a front view of the temperature control drum as viewed from the drum 22 side. As shown in FIG. 2, the temperature control drum 25 has a fluid feed port 26 and a fluid discharge port 27, and forms a fluid flow path in the circumferential direction. Although not shown, the feed port 26 and the discharge port 27 are connected to a fluid feed device via a tube or the like. By circulating the fluid while controlling the temperature of the fluid by this feed device, the temperature can be easily controlled.

The temperature of the temperature control portion 24 is determined based on results of the dimension measured in the dimension measuring step. More particularly, a relationship between the temperature of the temperature control portion 24 and the dimension of the ceramic molded body cut to have a predetermined length (which may, hereinafter, be abbreviated as a "cut ceramic molded body") is previously obtained. Based on the relationship, an appropriate temperature of the temperature control portion 24 is calculated from the dimension of the ceramic molded body measured in the dimensional measuring step as described later, and the temperature control portion 24 is controlled to the appropriate temperature.

The relationship between the temperature of the temperature control portion 24 and the dimension of the cut ceramic molded body can be obtained based on the past data accumulated by producing the ceramic molded bodies. Further, the relationship can be optimized in real-time by reflecting the data obtained by continuously carrying out the method for producing the ceramic molded body according to the embodiment of the present invention.

The relationship between the temperature of the temperature control portion 24 and the dimension of the cut ceramic molded body may differ depending on conditions such as a material and size of the ceramic molded body and a type of the extrusion molding machine 1. Therefore, it is preferable that the relationship is determined by rendering each of these conditions identical.

The dimension of the cut ceramic molded body used to obtain the relationship is not particularly limited. A diameter of a cut surface of the cut ceramic molded body (for example, a radius or diameter when the ceramic molded body has a circular pillar shape) is preferably used, and a value (ΔR) obtained by subtracting a previously defined reference value of a diameter of a cut surface of a reference ceramic molded body from the measured value of the measured diameter of the cut surface of the cut ceramic molded body is more preferably used. The use of these dimensions can allow the correlation of the relationship to be easily obtained.

In addition, as used herein, the "reference ceramic molded body" refers to a ceramic molded body having an ideal (target) dimension.

Figure 3:
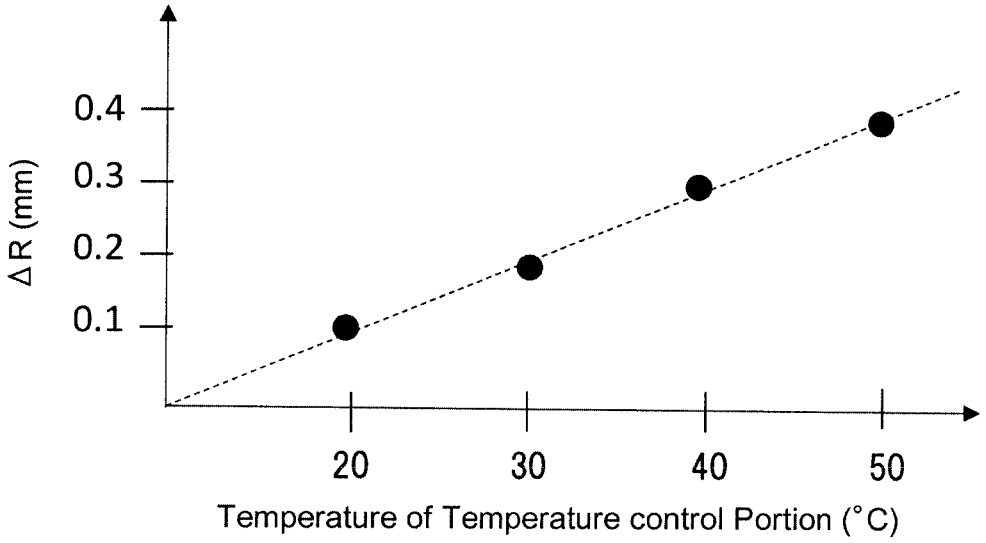
FIG. 3 is a graph showing an illustrative relationship between a temperature of a temperature control portion and a dimension of a ceramic molded body.

Here, FIG. 3 shows an example of the relationship between the temperature of the temperature control portion 24 and the dimension of the cut ceramic molded body.

The dimension of the cut ceramic molded body used to obtain the relationship as shown in FIG. 3 employed the value OR obtained by subtracting the previously defined reference value of the radius of the cut surface of the reference ceramic molded body from the measured value of the measured radius of the cut surface of the cut ceramic molded body. Used as the cut ceramic molded body was a circular pillar shaped honeycomb ceramic molded body produced under the same conditions except for the temperature of the temperature control portion 24. The cut ceramic molded body was produced as follows:

Using a cordierite-forming raw material containing alumina, kaolin and talc mixed together as a ceramic raw material, the cordierite-forming raw material was mixed with a binder including an organic binder, a water-absorbent resin as a pore former, and water (42% by mass) as a dispersion medium to form a ceramic raw material mixture, which was fed to the material introducing portion 17 of the extrusion molding machine 1 as shown in FIG. 1. The ceramic raw material mixture introduced from the material introducing portion 17 was kneaded in the extruding portion 10 to form the ceramic molding material, and the ceramic molding material was extruded from the die 21 of the molding portion 20 to obtain a ceramic molded body. The obtained ceramic molded body was cut to have a predetermined length using a wire rod hung between a pair of bobbins to obtain a cut ceramic molded body. The cut ceramic molded body has a honeycomb structure including partition walls that define a plurality of cells each extending from a first end face to a second end face, and has a quadrangular cell shape (a cell shape in a cross section orthogonal to a cell extending direction). Further, the ceramic molded body has a water content of 20%.

For the cut ceramic molded body obtained above, a radius of an upper half of the cut surface was measured while maintaining the axial direction of the cut ceramic molded body in the horizontal direction, using a method employing an end face inspection machine as described later. The value (ΔR) was calculated by subtracting the previously defined reference value of the radius of the cut surface of the reference ceramic molded body from the measured value of the radius of the cut surface of the cut ceramic molded body thus measured. A plurality of cut ceramic molded bodies were produced by changing the temperatures of the temperature control portion 24, and the relationship between the temperatures of the temperature control portion 24 and the dimensions (ΔR) of the cut ceramic molded bodies was obtained. A graph showing the relationship is shown in FIG. 3.

Figure 4:
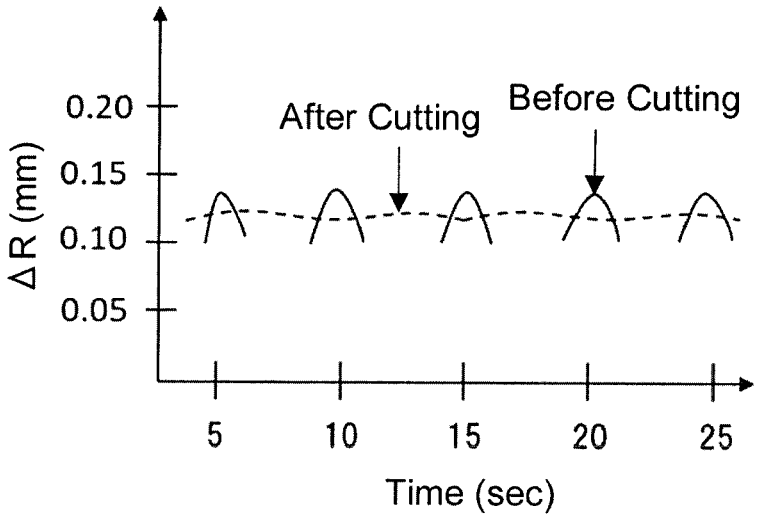
FIG. 4 is a graph showing a change in the dimension of the ceramic molded body produced based on the relationship between the temperature of the temperature control portion and the dimension of the ceramic molded body, as a function of time.

The value of ΔR has a relationship that changes as shown in FIG. 3 depending on the temperatures of the temperature control portion 24. Therefore, an appropriate temperature of the temperature control portion 24 may be calculated from the dimension (ΔR) of the cut ceramic molded body measured in the dimension measuring step as described later based on that relationship, and the temperature of the temperature control portion 24 may be controlled. For example, when the temperature of the temperature control portion 24 is set to 25° C. to produce the ceramic molded body, the temperature of the temperature control portion 24 may be controlled to 30° C. when it is desired to decrease the dimension (ΔR) of the cut ceramic molded body measured in the dimensional measuring step described later by 0.1 mm. FIG. 4 shows a graph illustrating a change (referred to as "after cutting") in the dimension (ΔR) of the cut ceramic molded body produced by thus controlling the temperature of the temperature control portion 24, as a function of time. In addition, FIG. 4 also shows, as a reference, a change (referred to as "before cutting") in the dimension (ΔR) of the cut ceramic molded body as a function of time, which was produced by determine the same relationship as that described above for the ceramic molded body before cutting and controlling the temperature of the temperature control portion 24.

As shown in FIG. 4, when the appropriate temperature of the temperature control portion 24 was controlled based on the relationship using the dimension (ΔR) of the ceramic molded body after cutting (the cut ceramic molded body), the dimension of the cut ceramic molded body could be stably decreased as compared with a case where the appropriate temperature of the temperature control portion 24 was controlled based on the relationship using the dimension (ΔR) of the ceramic molded body before cutting. Therefore, the dimensional accuracy of the cut ceramic molded body can be quickly and stably improved by previously determining the relationship between the temperature of the temperature control portion 24 and the dimension of the cut ceramic molded body, calculating the appropriate temperature of the temperature control portion 24 based on the dimension of the cut ceramic molded body measured in the dimension measuring step, and controlling the temperature of the temperature control portion 24 in the molding step.

Optionally, an outer circumference of the drum 22 (molding portion 20) may preferably be covered with a heat insulating sheet (not shown). Such a configuration can allow the temperature inside the drum 22 to be maintained at a predetermined temperature, so that the effect of improving the dimensional accuracy of the ceramic molded body can be enhanced.

The molding step can carry out using the extrusion molding machine 1 having the structure as described above. In the molding step, a ceramic raw material mixture is fed from the material introducing portion 17 to the interior of the barrel 12. The ceramic raw material mixture is kneaded while being subjected to shearing force by the rotation of the screw 11 to form a ceramic molding material, which is conveyed to the extruding port 13 side at the tip of the barrel 12. The ceramic molding material extruded from the extruding port 13 of the barrel 12 passes through the through holes of the rectifier 30, and passes through the screen 23 to be fed to the die 21. The ceramic molding material is extruded through the die 21 into a desired shape.

The ceramic molding material can be obtained by kneading the ceramic raw material mixture.

The ceramic raw material mixture may contain ceramic raw materials and water, although not particularly limited thereto.

Examples of the ceramic raw materials that can be used include, but not particularly limited to, cordierite-forming raw materials, cordierite, silicon carbide, silicon-silicon carbide composite materials, mullite, aluminum titanate, and the like. These can be used alone or in combination of two or more. As used herein, the cordierite-forming raw material refers to a ceramic raw material formulated so as to have a chemical composition in which silica is in a range of from 42 to 56% by mass, alumina is in a range of from 30 to 45% by mass, and magnesia is in a range of from 12 to 16% by mass. The cordierite-forming raw material is calcined to form cordierite.

In addition to the ceramic raw materials and water, the ceramic raw material mixture may also contain a dispersion medium other than water, a binder (for example, an organic binder, an inorganic binder, or the like), a pore former, a surfactant, and the like. Each raw material has any composition ratio, and preferably has a composition ratio according to the structure, material, and the like of the ceramic molded body to be produced.

The ceramic molded body obtained by extrusion molding preferably has a water content of from 10 to 50%. The ceramic molded body having the water content in such a range can allow the dimensional accuracy of the ceramic molded body to be stably improved by the method for producing the ceramic molded body according to the embodiment of the present invention.

As used herein, the water content of the ceramic molded body refers to a water content measured by an infrared heating type moisture meter.

(Cutting Step)

The cutting step is to cut the ceramic molded body obtained by extrusion molding to have a predetermined length.

The cutting method is not particularly limited, and a method known in the art can be used. For example, the ceramic molded body can be cut by using a wire rod hung between a pair of bobbins.

The length of the ceramic molded body to be cut is not particularly limited, and the ceramic molded body may be cut to have an appropriate length depending on applications.

The structure of the cut ceramic molded body preferably has a honeycomb structure including partition walls that define a plurality of cells each extending from a first end face to a second end face, although not particularly limited thereto.

The ceramic molded body having a honeycomb structure (hereinafter referred to as a "honeycomb molded body") may have a non-limiting shape, including a circular pillar shape, an elliptical pillar shape, and a polygonal pillar shape having end faces in the form of square, rectangular, triangular, pentagonal, hexagonal, octagonal, and the like.

Further, the honeycomb molded body may have a non-limiting cell shape (a cell shape in the cross section orthogonal to the cell extending direction), including a triangle, a quadrangle, a hexagon, an octagon, a circle, or a combination thereof.

(Dimension Measuring Step)

The dimensional measuring step is to measure the dimension of the cut ceramic molded body.

The method for measuring the dimension of the cut ceramic molded body is not particularly limited, and a method known in the art can be used. For example, the dimension of the cut ceramic molded body can be measured using an end face inspection machine, a laser type outer diameter dimension measuring device, or the like.

However, it is preferable that the measuring method used in the dimension measuring step is the same as the measuring method for the dimension of the ceramic molded body used to obtain the relationship between the temperature of the temperature control portion 24 and the dimension of the cut ceramic molded body. Further, the dimension of the cut ceramic molded body measured in the dimension measuring step is preferably the same as the dimension of the ceramic molded body used to obtain the relationship between the temperature of the temperature control portion 24 and the dimension of the cut ceramic molded body.

The dimension of the cut ceramic molded body measured in the dimension measuring step is not particularly limited. A diameter of a cut surface of the cut ceramic molded body (for example, a radius or diameter of the cut surface when the ceramic molded body has a circular pillar shape) is preferably used, and a value ($\Delta R$) obtained by subtracting a previously defined reference value of a diameter of a cut surface of a reference ceramic molded body from the measured value of the measured diameter of the cut surface of the cut ceramic molded body is more preferably used. The diameter of the cut surface of the cut ceramic molded body can be calculated by measuring the radii at a plurality of positions after a correction process of a center position as described later and averaging the measured values.

The dimension of the cut ceramic molded body can be measured at the end face (cut surface) or the side surface of the cut ceramic molded body.

Further, the dimension of the cut ceramic molded body may be measured over the entire end face or the entire side surface of the cut ceramic molded body, but it is preferably measured at a part of the end face or the side surface of the cut ceramic molded body.

When measuring the dimension of the entire end face or the entire side surface of the cut ceramic molded body, an axial direction (extrusion molding direction) of the cut ceramic molded body should be matched to a vertical direction, so that the cut ceramic molded body has to be rotated by 90° to measure the dimension, which requires a long period of time. Therefore, it is preferable to leave the axial direction (extrusion molding direction) of the cut ceramic molded body in the horizontal direction and measure the dimension a part (for example, an upper half) of the end face or the side surface of the cut ceramic molded body from the upper direction. Such a measuring method can allow a measurement time to be shortened. In this case, it is preferable to perform a correction process of the center position of the measured shape so that an error from a reference shape is minimized.

When measuring the dimension of the end face of the cut ceramic molded body, an end face image of the cut ceramic molded body is taken by an imaging camera of the end face inspection machine. The contour of the cut ceramic molded body may be detected from the obtained end face image by means of image analysis, and the dimension (outer diameter, radius) of the cut ceramic molded body may be calculated.

When measuring the dimension of the side surface of the cut ceramic molded body, the side surface of the cut ceramic molded body is irradiated with a laser from a laser displacement meter of a laser type outer diameter dimension measuring device. The laser oscillated from the laser displacement meter reaches the side surface of the cut ceramic molded body and is reflected. The reflected laser may be detected by a light receiving element, and the dimension of the cut ceramic molded body may be calculated based on the principle of the triangulation ranging method.

In the method for producing the ceramic molded body according to the embodiment of the present invention including the above steps, the temperature of the temperature control portion 24 in the molding step is controlled to the appropriate temperature based on the measurement result of the dimension of the cut ceramic molded body. Therefore, the dimensional accuracy of the ceramic molded body can be quickly and stably improved.

(2) Method for Producing Ceramic Structure

The method for producing the ceramic structure according to the embodiment of the present invention includes a drying step of drying the ceramic molded body obtained by the method for producing the ceramic molded body as described above, and a firing step of firing the dried ceramic molded body.

(Drying Step)

The drying step is to dry the ceramic molded body.

The method for drying the ceramic molded body is not particularly limited, and a method known in the art can be used. For example, the ceramic molded body may be placed on a drying cradle, conveyed between a pair of electrodes, and subjected to dielectric drying by passing an electric current between the electrodes. The dielectric drying is to subject dipoles of water in the ceramic molding body to molecular motion by a high frequency energy generated by passing the electric current between the pair of electrodes, and dry the ceramic molding body by frictional heat caused by the molecular motion.

In addition, as the drying conditions, known conditions can be appropriately selected according to the outer shape and material of the honeycomb structure to be produced.

(Firing Step)

The firing step is to fire the dried ceramic molded body.

The method for firing the ceramic molded body is not particularly limited, and a method known in the art can be used. For example, the ceramic molded body may be fired in a firing furnace.

In addition, as the firing conditions, known conditions can be appropriately selected according to the outer shape and material of the honeycomb structure to be produced. Further, organic substances such as the binder may be removed by calcination prior to the firing.

Since the method for producing the ceramic structure according to the embodiment of the present invention including the above steps uses the ceramic molded body obtained by the method for producing the ceramic molded body as described above, the dimensional accuracy of the ceramic structure can be stably improved.

DESCRIPTION OF REFERENCE NUMERALS

1 extrusion molding machine
10 extruding portion
11 screw
12 barrel
13 extruding port
14 screw shaft
15 blade portion
16 drive device
17 material introducing portion
20 molding portion
21 die
22 drum
23 screen
24 temperature control portion
25 temperature control drum
26 feed port
27 discharge port

The invention claimed is:

1. A method for producing a ceramic molded body, the method comprising:

a molding step of subjecting a ceramic molding material to extrusion molding using an extrusion molding machine equipped with a temperature control portion to provide a ceramic molded body;

a cutting step of cutting the ceramic molded body to have a predetermined length; and a dimension measuring step of measuring a dimension of the cut ceramic molded body before drying;

wherein a relationship between a temperature of the temperature control portion and the dimension of the cut ceramic molded body is previously obtained, and based on the relationship, an appropriate temperature of the temperature control portion is calculated from the dimension of the ceramic molded body measured in the dimension measuring step, and the temperature control portion is controlled to the appropriate temperature in the molding step.

2. The method according to claim 1, wherein the dimension of the ceramic molded body is a value obtained by measuring a diameter of a cut surface of the ceramic molded body, and subtracting a previously defined reference value of a diameter of a cut surface of a reference ceramic molded body from the measured value of the measured diameter of the cut surface of the ceramic molded body.

3. The method according to claim 1, wherein the temperature control portion is a temperature control drum provided between a screen and a die.

4. The method according to claim 1, wherein the ceramic molded body has a water content of from 10 to 50%.

5. The method according to claim 1, wherein the cut ceramic molded body has a honeycomb structure comprising partition walls that define a plurality of cells each extending from a first end surface to a second end surface.

6. A method for producing a ceramic structure, the method comprising:

a drying step of drying the ceramic molded body obtained by the method according to claim 1; and a firing step of firing the dried ceramic molded body.

* * * * *